US009650890B2

(12) United States Patent
Scott

(10) Patent No.: US 9,650,890 B2
(45) Date of Patent: May 16, 2017

(54) APPARATUSES AND METHODS FOR EVALUATING WELL PERFORMANCE USING DEVIATIONS IN REAL-TIME WELL MEASUREMENT DATA

(71) Applicant: Phase Dynamics, Inc., Richardson, TX (US)

(72) Inventor: Bentley N. Scott, Garland, TX (US)

(73) Assignee: Phase Dynamics, Inc., Richardson, TX (US)

( * ) Notice: Subject to any disclaimer, the term of this patent is extended or adjusted under 35 U.S.C. 154(b) by 45 days.

(21) Appl. No.: 14/817,524

(22) Filed: Aug. 4, 2015

(65) Prior Publication Data

US 2016/0333686 A1 Nov. 17, 2016

Related U.S. Application Data

(60) Provisional application No. 62/162,716, filed on May 16, 2015, provisional application No. 62/162,717, filed on May 16, 2015.

(51) Int. Cl.
*E21B 49/08* (2006.01)

(52) U.S. Cl.
CPC ..... *E21B 49/08* (2013.01)

(58) Field of Classification Search
CPC ..... E21B 47/06; E21B 47/10; E21B 47/00
USPC ..... 73/152.18, 152.23, 152.29, 152.31, 73/152.51, 152.52, 861.04, 61.44
See application file for complete search history.

(56) References Cited

U.S. PATENT DOCUMENTS

2001/0000060 A1* 3/2001 Toma ..... G01F 1/74 73/61.44
2007/0038399 A1* 2/2007 Scott ..... G01N 33/2847 702/100
2007/0157708 A1* 7/2007 Scott ..... G01N 9/36 73/61.44
2007/0239402 A1* 10/2007 Scott ..... G01N 22/00 702/189
2007/0295501 A1* 12/2007 Poulisse ..... E21B 47/10 166/250.01
2008/0217005 A1* 9/2008 Stluka ..... E21B 43/34 166/250.01

(Continued)

*Primary Examiner* — Michael A Lyons
*Assistant Examiner* — Philip Cotey

(57) ABSTRACT

An apparatus for analyzing the output of a plurality of oil wells. The apparatus comprises: i) a plurality of test headers coupled to the plurality of wells via a field testing infrastructure; and ii) a test separator configured to select a first well for testing and to receive a multiphase fluid flow from a first one of the plurality of test headers, the first test header associated with the first well. The test separator is further configured to: iii) separate the multiphase fluid flow into a gas phase stream and a liquid phase stream; iv) measure a plurality of parameters of the gas phase stream and the liquid phase stream over a current period; v) for each of the plurality of parameters, determine a mean value, a standard deviation, a maximum value, and a minimum value in the current period; and vi) determine if a standard deviation associated with a first parameter exceeds a first threshold of a mean value associated with the first parameter. If the standard deviation exceeds the first threshold, the test separator flags the first oil well as having a problem.

16 Claims, 10 Drawing Sheets

(56) References Cited

U.S. PATENT DOCUMENTS

| | | | | |
|---|---|---|---|---|
| 2014/0137643 | A1* | 5/2014 | Henry | E21B 21/063<br>73/152.31 |
| 2015/0226062 | A1* | 8/2015 | Machado | G06F 17/50<br>73/152.29 |

* cited by examiner

400

600

700

| Well | Prod | Test Duration hrs | Date | Oil BBL | Wtr BBL | Tot BBL | Water Cut | Form Gas mcfd | Lift Gas mcfd | Total Gas mcfd | Well Head Temp F | Sep Pres psi | GOR | GLR |
|---|---|---|---|---|---|---|---|---|---|---|---|---|---|---|
| B03 | GL | 6:00 | 01/10/13 | 212 | 2442 | 2654 | 92% | 140 | 797 | 937 | 144 | 167 | 660 | 353 |
| B03 | GL | 1:00 | 01/13/13 | 224 | 2581 | 2805 | 92% | 125 | 801 | 926 | 144 | 168 | 558 | 330 |
| B03 | GL | 6:00 | 01/30/13 | 194 | 2236 | 2430 | 92% | 143 | 801 | 944 | 143 | 168 | 737 | 388 |
| B03 | GL | 6:00 | 02/11/13 | 187 | 2155 | 2342 | 92% | 53 | 795 | 848 | 143 | 181 | 283 | 362 |
| B03 | GL | 6:00 | 02/13/13 | 188 | 2166 | 2354 | 92% | 58 | 794 | 852 | 143 | 181 | 309 | 362 |
| B03 | GL | 6:00 | 02/15/13 | 180 | 2070 | 2250 | 92% | 20 | 799 | 819 | 143 | 181 | 111 | 364 |
| B03 | GL | 6:00 | 02/18/13 | 179 | 2063 | 2242 | 92% | 47 | 792 | 839 | 143 | 180 | 263 | 374 |
| B03 | GL | 6:00 | 02/20/13 | 180 | 2066 | 2246 | 92% | 44 | 795 | 839 | 143 | 180 | 244 | 374 |
| B03 | GL | 6:00 | 02/26/13 | 173 | 1989 | 2162 | 92% | 54 | 797 | 851 | 143 | 184 | 312 | 394 |
| B03 | GL | 6:00 | 03/05/13 | 175 | 2008 | 2183 | 92% | 72 | 795 | 867 | 142 | 182 | 411 | 397 |

FIGURE 7

800

| Well 6 F10 201110908 | Liquid Flow Rate bbls/day | Gas Flow Rate mscfd | Pressure psi | level % | liquid density kg/m3 | Gas Density kg/m3 | Water % % |
|---|---|---|---|---|---|---|---|
| Mean | 1088 | 2553 | 350 | 59.3 | 990 | 11.4 | 93.8 |
| Std Dev | 400 | 115 | 2.56 | 3.5 | 13 | 2.1 | 11.4 |
| Max | 2158 | 2919 | 359 | 66.9 | 1006 | 15.2 | 99.9 |
| Min | 625 | 2194 | 344 | 54.0 | 955 | 7.4 | 64.8 |

FIGURE 8

900

| Well 6 F10 201110908 | Liquid Flow Rate bbls/day | Gas Flow Rate mscfd | Pressure psi | level % | liquid density kg/m3 | Gas Density kg/m3 | Water % % |
|---|---|---|---|---|---|---|---|
| Mean | 1088 | 2553 | 350 | 59.3 | 990 | 11.4 | 93.8 |
| Std Dev | 400 | 115 | 2.56 | 3.5 | 13 | 2.1 | 11.4 |
| Max | 2158 | 2919 | 359 | 66.9 | 1006 | 15.2 | 99.9 |
| Min | 625 | 2194 | 344 | 54.0 | 955 | 7.4 | 64.8 |

| Well 6 F10 20120102 | Liquid Flow Rate bbls/day | Gas Flow Rate mscfd | Pressure psi | level % | liquid density kg/m3 | Gas Density kg/m3 | Water % % |
|---|---|---|---|---|---|---|---|
| Mean | 745 | 3742 | 370 | 90.5 | 1008 | 28.1 | 96.0 |
| Std Dev | 365 | 576 | 2.79 | 2.0 | 19 | 3.1 | 8.5 |
| Max | 2875 | 8156 | 380 | 95.2 | 1020 | 41.2 | 100.0 |
| Min | 9 | 1241 | 364 | 84.7 | 735 | 7.5 | 65.0 |

| Well 6 F10 20120106 | Liquid Flow Rate bbls/day | Gas Flow Rate mscfd | Pressure psi | level % | liquid density kg/m3 | Gas Density kg/m3 | Water % % |
|---|---|---|---|---|---|---|---|
| Mean | 802 | 3706.5 | 394 | 90.2 | 1007 | 28.3 | 96.1 |
| Std Dev | 371 | 575 | 8.93 | 2.0 | 21 | 3.2 | 9.1 |
| Max | 3559 | 7120 | 408 | 95.1 | 1022 | 43.1 | 100 |
| Min | 21 | 1241 | 364 | 84.7 | 735 | 11.6 | 65 |

FIGURE 9

1000

| Well 6 F10 201110908 | Liquid Flow Rate bbls/day | Gas Flow Rate mscfd | Pressure psi | level % | liquid density kg/m3 | Gas Density kg/m3 | Water % % | |
|---|---|---|---|---|---|---|---|---|
| Mean | 1088 | 2553 | 350 | 59.3 | 990 | 11.4 | 93.8 | |
| Std Dev | 400 | 115 | 2.56 | 3.5 | 13 | 2.1 | 11.4 | |
| Max | 2158 | 2919 | 359 | 66.9 | 1006 | 15.2 | 99.9 | |
| Min | 625 | 2194 | 344 | 54.0 | 955 | 7.4 | 64.8 | |
| **INDEX** | **6.3** | **9.5** | **9.9** | **9.4** | **9.9** | **8.1** | **8.8** | **8.9** |

| Well 6 F10 20120102 | Liquid Flow Rate bbls/day | Gas Flow Rate mscfd | Pressure psi | level % | liquid density kg/m3 | Gas Density kg/m3 | Water % % | |
|---|---|---|---|---|---|---|---|---|
| Mean | 745 | 3742 | 370 | 90.5 | 1008 | 28.1 | 96.0 | |
| Std Dev | 365 | 576 | 2.79 | 2.0 | 19 | 3.1 | 8.5 | |
| Max | 2875 | 8156 | 380 | 95.2 | 1020 | 41.2 | 100.0 | |
| Min | 9 | 1241 | 364 | 84.7 | 735 | 7.5 | 65.0 | |
| **INDEX** | **5.1** | **8.5** | **9.9** | **9.8** | **9.8** | **8.9** | **9.1** | **8.7** |

| Well 6 F10 20120106 | Liquid Flow Rate bbls/day | Gas Flow Rate mscfd | Pressure psi | level % | liquid density kg/m3 | Gas Density kg/m3 | Water % % | |
|---|---|---|---|---|---|---|---|---|
| Mean | 802 | 3706.5 | 394 | 90.2 | 1007 | 28.3 | 96.1 | |
| Std Dev | 371 | 575 | 8.93 | 2.0 | 21 | 3.2 | 9.1 | |
| Max | 3559 | 7120 | 408 | 95.1 | 1022 | 43.1 | 100 | |
| Min | 21 | 1241 | 364 | 84.7 | 735 | 11.6 | 65 | |
| **INDEX** | **5.4** | **8.4** | **9.8** | **9.8** | **9.8** | **8.9** | **9.1** | **8.7** |

FIGURE 10

APPARATUSES AND METHODS FOR EVALUATING WELL PERFORMANCE USING DEVIATIONS IN REAL-TIME WELL MEASUREMENT DATA

CROSS-REFERENCE TO RELATED APPLICATION(S) AND CLAIM OF PRIORITY

The present application is related to U.S. Provisional Patent No. 62/162,716, entitled "Well Measurement With Anomaly Analysis", and to U.S. Provisional Patent No. 62/162,717, entitled "Well Measurement With Statistical Optimization". Provisional Patent Nos. 62/162,716 and 62/162,717 are assigned to the assignee of the present application and are hereby incorporated by reference into the present application as if fully set forth herein. The present application claims priority under 35 U.S.C. §119(e) to U.S. Provisional Patent No. 62/162,716 and 62/162,717.

The present application is related to U.S. patent application Ser. No. 14/817,482, entitled "Apparatuses and Methods for Detecting Faults in Pipeline Infrastructure Using Well Measurement Data," filed concurrently herewith. Application Ser. No. 14/817,482 is assigned to the assignee of the present application and is hereby incorporated by reference into the present application as if fully set forth herein.

TECHNICAL FIELD

The present application relates generally to apparatuses and methods for characterizing a multiphase fluid flow stream that has varying phase proportions over time and, in particular, to improved systems and methods for measuring the amount of oil, water, and gas in a production well.

BACKGROUND

Crude petroleum oil and gaseous hydrocarbons are produced by extraction from subterranean reservoirs. Some reservoirs with enough natural pressure the oil and gas flows to the surface without secondary lift techniques. Often, however, other methods are required to bring them to the surface. These include a variety of pumping, injection, and lifting techniques used at various locations, such as at the surface wellhead (e.g. use of rocking beam suction pumping), at the bottom down-hole of the well (e.g. use of submersed pumping), with gas injection into the well casing creating lift and other techniques. Each of these techniques results in crude petroleum oil and gas emerging from the well head as a multiphase fluid with varying proportions of oil, water, and gas. For example, a gas lift well has large volumes of gas associated with the well. The gas-to-oil volumetric ratios can be 200 standard cubic feet of gas per barrel of oil, or higher. The complexity of the flow regimes can create large measurement uncertainties depending upon the methods.

Multiphase measurement typically provides an oil company and a stakeholder the amount of gas, oil, and water and the average temperature, pressure, gas/oil ratio, and gas volume fraction that a well produces in a day. Conventional three-phase separators, two-phase separators, and modern multiphase flow-through measurement devices capture this information. Conventional three-phase systems separate the gas, oil, and water streams, then measure the three streams with a flow meter. A two-phase system separates the gas from the liquids (oil, water), measures the flow of each, and uses a water/oil detector to obtain the oil and water rates.

Newer multiphase systems use multiple detection methods, such as Venturi, gamma, or cesium sources, as well as other methods to obtain the oil, water, and gas flow rates without separation.

These tests are used to determine each well's contribution to the output streams of the production plant. The total measured production at the output is typically at lower pressures and temperatures than the inputs measured at the well test systems, which complicates the comparison of the sums of the individual well streams. The sum of the individual well test results compared to the total seen at production may be expressed as a ratio and is called the "allocation factor". Typically, the allocation factor value may range from 0.9 to 1.1.

Since crude oil shrinks with temperature, the shrinkage must be compensated for in making the comparison. Gas volume is dependent upon temperature and pressure and this must also be considered. The test separator measurement under normal operating conditions cannot be expected to give an uncertainty of better than +/−10% to +/−20% of the reading of each phase volume flow rate. The metering uncertainty of conventional single-phase meters on a test separator varies from field to field and in most cases is very difficult to estimate.

Hydrocarbon well optimization methods include adjusting the well operating parameters and employing reservoir stimulation techniques. The effectiveness of such optimization methods is greatly enhanced if accurate well test data of the oil well is available. Specifically, in one context of hydrocarbon well production optimization, it is important to be able to determine the amount of water mixed with the crude oil. The water may be present as naturally produced ground water, water from steam injection, and/or well injection water that eventually mixed with the oil as a result of a reservoir stimulation process. One such stimulation process is known as Steam Assisted Gravity Drain stimulation ("SAGD"). Another stimulation process is the "huff and puff" stimulation method where steam is intermittently injected into the reservoir. Different types of stimulation processes can have different phase states upon start-up of the well.

A further complexity to the multiphase characteristics of crude petroleum oil stems from the fact that a given well with a given production technique does not produce a constant multiphase composition and flow rate. Production depletes reservoirs, thereby decreasing the output of hydrocarbon over time. On the other hand, well composition and volumetric output can change in a matter of seconds because a well is a vertical separator that tends to separate the gas and the liquids. For example, upon start-up, a well can take several minutes or several hours to reach steady-state operation. Therefore, a well stabilization period, typically called a "purge time", is done before starting the actual well test.

Regardless of production technique, one constant requirement for all hydrocarbon well operations is the need to determine how much oil and gas a given well is producing over a given period (i.e., the well production rate). To that end, well testing is routinely conducted on a given well to establish the gas, water and oil flow rates.

The need for accurately characterizing a particular well's performance is important to well operation and production output optimization. Optimization operations reduce equipment failure and improve decisions to work over a well. Variable multiphase flow patterns are generated by drill string behavior, various bottom hole configurations, and possible differing layers of oil and gas in a given hydrocarbon formation. Interpreting the well characterization data requires consideration of differing patterns of well behavior, various cyclic well behaviors, and varying durations of peak and minimum flows.

The variable production techniques and the resulting varying multiphase fluids present significant challenges to well testing systems and methods. For the most part, determination of the volume of gas and volume of liquid produced over a given time is relatively easily established using gas-liquid separation techniques, and gas and liquid flow metering techniques known to a person having ordinary skill in the art of quantifying hydrocarbon well output production. However, a significant challenge lies in determining if the well test is acceptable and without reliability problems.

Data Collection During Well Testing

The actual proposed use of the well test data is not always specified in the beginning Whether for field evaluation, development and allocation of production of a new field, process control, and/or payment of taxes, the manner in which the data was obtained is important to the validity of using the data for the stated purpose. Field evaluation may only require a +/−10% accuracy, while fiscal measurement may place much tighter requirements on the design. If the data is obtained by integration over 10 minute intervals, the problems in separator efficiency, slug handling, and level control may not be observable in the data. Conversely, if the data is obtained and displayed on a 5 second interval, most operators would not interpret the data in a favorable light.

The perceived operation of a system versus the actual operation is very different in some cases. The rapid changing of data due to fluid characteristics may be interpreted as a problem with the system. Thus, if the same data had been integrated and presented differently, the same operator would believe the system is okay. Although unacceptable to the operator, this "fast" data may be of much interest to the production engineer or the reservoir engineer, since it may shed light on the actual performance of the well, the separator, and the control system. Data for fiscal use may only be the sum total oil/water/gas production per day with all periods of less than one day being inconsequential.

Various industry groups may specify sizes and types of particular components to be used in well test systems. The vessel itself may be purchased from a separator design company with the remainder specified by an engineering company. In too many instances, the designer is removed from the person specifying the field parameters and needs. In many instances, the company designing the equipment may never actually visit the field or talk to the end users of the equipment. This makes the process very dependent on the communications between the various operating groups and leads to many problems once the equipment is on site. Once the equipment arrives on the site and is commissioned by a third party, the operation is turned over to the field production groups. Thus, in many cases, it is the end user that must make the system work.

Different segments of the market require different solutions depending on whether the customer is in the Arctic, South America, or the North Sea. The difference may not necessarily be in the technology, but in the application of technology in the field. Heavy oil versus light oil applications require very different approaches to well tests. Another difference could be in the method of presenting the data to the end user. The equipment may need to be designed for simplicity or complexity depending upon the measurement needs, capital money available, and knowledge and sophistication of the operators of the fields. Several other design parameters that may affect well testing include: fluid viscosity, water cut, gas-oil ratio, oil density, water salinity, gas composition, distance of test equipment from the well head, flow stability, and reporting requirements of the operation. Today, fewer technicians are available and higher equipment reliability is required. The system maintenance must be straightforward and simple to identify problems.

Although the selection of the measurement instruments is very important to the end accuracy, the instruments are but one part of the system. The system must work as a whole and the data obtained must be consistent with the end use. The algorithms used to interpret the data collected from the separate instruments are critical to the operation of the whole. This is true whether it is a complex state-of-the-art multiphase analyzer or a two-phase vessel with standard instrumentation.

Thus, there is a need for improved systems and methods for evaluating the quality of data being measured in a well test. More particularly, there is a need for improved systems and methods for summarizing and qualifying the data measured in a well test in order to accept or reject a given well test.

SUMMARY

To address the above-discussed deficiencies of the prior art, it is a primary object to provide an apparatus for analyzing the output of a plurality of oil wells. In an advantageous embodiment, the apparatus comprises: i) a plurality of test headers coupled to the plurality of wells via a field testing infrastructure; and ii) a test separator configured to select a first well for testing and to receive a multiphase fluid flow from a first one of the plurality of test headers, the first test header associated with the first well. The test separator is further configured to: iii) separate the multiphase fluid flow into a gas phase stream and a liquid phase stream; iv) measure a plurality of parameters of the gas phase stream and the liquid phase stream over a current period; v) for each of the plurality of parameters, determine a mean value, a standard deviation, a maximum value, and a minimum value in the current period; and vi) determine if a standard deviation associated with a first parameter exceeds a first threshold of a mean value associated with the first parameter. If the standard deviation exceeds the first threshold, the test separator flags the first oil well as having a problem.

In one embodiment, the test separator is further configured to: i) compare the mean value of the first parameter in the current period to a mean value of the first parameter in a previous period; ii) determine if a change in the mean value of the first parameter between the previous period and the current period exceeds a second threshold; and iii) if the change in the mean value of the first parameter exceeds the second threshold, flag the first oil well as having a problem.

In another embodiment, the test separator is further configured to: i) compare the maximum value of the first parameter in the current period to a maximum value of the first parameter in a previous period; ii) determine if a change in the maximum value of the first parameter between the previous period and the current period exceeds a second threshold; and iii) if the change in the maximum value of the first parameter exceeds the second threshold, flag the first oil well as having a problem.

In still another embodiment, the test separator is further configured to: i) compare the minimum value of the first parameter in the current period to a minimum value of the first parameter in a previous period; ii) determine if a change in the minimum value of the first parameter between the previous period and the current period exceeds a second threshold; and iii) if the change in the maximum value of the first parameter exceeds the second threshold, flag the first oil well as having a problem.

In yet another embodiment, the test separator is further configured to determine a qualifier for a well test, the qualifier identifying a degree to which the well test is within expected reproducibility.

The qualifier may be given by: Qualifier=[1−(Std. Dev./Mean Value)]×10.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 7 illustrates a standard well test subset of data.

FIG. 8 illustrates new well test data according to an embodiment of the disclosure.

FIG. 9 illustrates three exemplary well test measurement data.

FIG. 10 illustrates three exemplary well test measurement data with additional qualifiers according to an exemplary embodiment of the disclosure.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged petroleum production pipeline infrastructure.

This disclosure relates generally to systems and methods for characterizing a multiphase fluid flow stream that has varying phase proportions over time and, in particular, to improved systems and methods for measuring the amount of oil, water, and gas in a production well. Using the available data to optimize understanding of the quality of data during a well test is very important to either accepting or rejecting a particular well test and also for flagging a problem with a given well. Typically, at the end of a well test, a small set of summary data is available that provides considerable opportunity to summarize, quantify, and qualify the results. The present disclosure describes a routine of obtaining statistical deviations from real time data to better summarize and qualify a well test.

Figure 1:
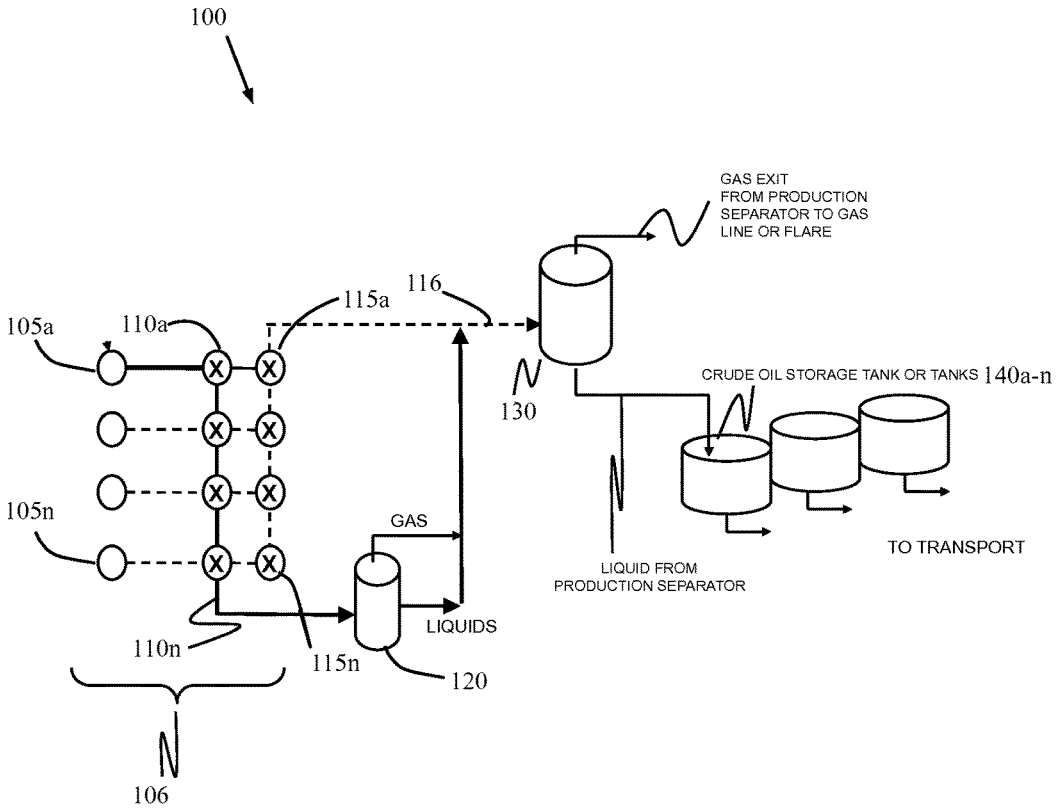
FIG. 1 illustrates an exemplary petroleum processing and transportation system in accordance with one embodiment of the disclosure.

FIG. 1 illustrates exemplary petroleum processing and transportation system 100 according to one embodiment of the disclosure. Exemplary system 100 comprises numerous components of a petroleum pipeline infrastructure, including a plurality of petroleum-producing wells 105*a*-105*n*, a plurality of test headers 110*a*-110*n*, a plurality of production headers 115*a*-115*n*, test separator 120, production separator 130, and a plurality of crude oil storage tanks 140*a*-104*n*. A reservoir testing infrastructure (or field testing infrastructure) of valves and pipelines connects each of wells 105*a-n* to one of test headers 110*a-n* and to one of production headers 115*a-n*. An additional production well infrastructure (or group well production infrastructure) of valves and pipelines connects production separator 130 to production headers 115*a-n*. Each of wells 105*a-n* may be located on land or undersea.

According to the principles of the present disclosure, test separator 120 is configured to receive sample streams of multi-phase fluid (e.g., oil, water, gas) from each of test headers 110*a*-110*n* and to perform tests that, among other things, verify the integrity and proper configuration of field testing infrastructure 106 that connects the N oil wells 105*a-n* to the N test headers 110*a-n*. After testing in test separator 120, the separated gas and liquids output from test separator 120 are recombined and injected into the multiphase fluids steam(s) that are entering production separator 130.

Similarly, production separator 130 may be configured to receive sample streams of multi-phase fluid (e.g., oil, water, gas) from each of production headers 115*a*-115*n* and to perform tests that verify the integrity and proper configuration of production well infrastructure 116 (indicated generally by dotted line) that connects the N production headers 115*a-n* to production separator 130. Production separator 130 may also obtain and analyze statistical deviations from real time data to better summarize and qualify a well test according to the principles of the disclosure. In one embodiment, production separator 130 is configured to receive and to test individual multiphase fluid streams from each of production headers 115*a*-115*n* and to combine the test results of the individual streams with the test results received from test separator 120 in order to verify the integrity and proper configuration of production well infrastructure 116. In an alternate embodiment, production separator 130 is configured to receive and to test only a single multiphase fluid stream that is the combined output from all production headers 115*a*-115*n* and to combine the test results of the combined multiphase fluid stream with the test results received from test separator 120 in order to verify the integrity and proper configuration of production well infrastructure 116.

After testing in production separator 120, the separated gas from production separator 130 may be burned off in a flare or entered into a pipeline. The separated liquids from production separator 130 are stored in one or more storage tanks 140*a*-*n* prior to subsequent transport.

Figure 2:
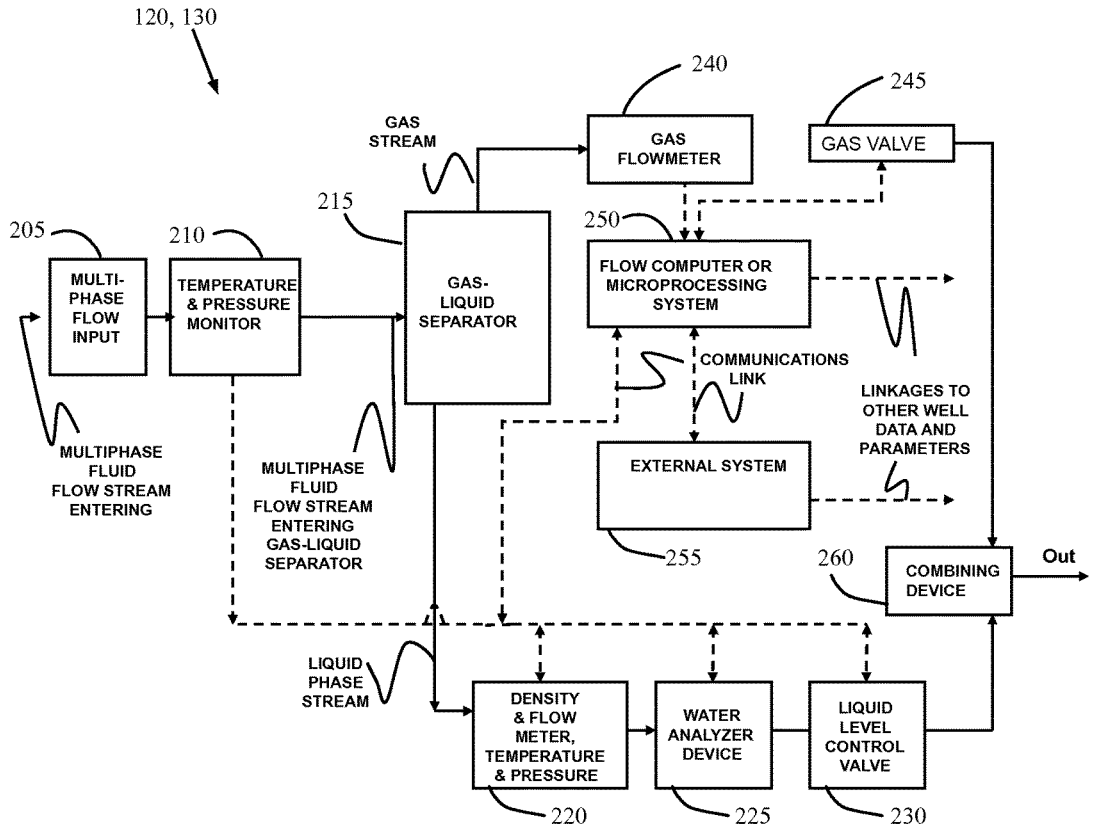
FIG. 2 illustrates an exemplary embodiment of a test separator or a production separator according to the principles of the present disclosure.

FIG. 2 illustrates an exemplary embodiment of test separator 120 or production separator 130 according to the principles of the present disclosure. Because production separator 130 is similar in most respects to test separator 120, the following description will, for the purposes of simplicity and brevity, focus mostly on discussion of test separator 120. However, except where noted or where the context makes it obvious that only one separator is being discussed, the description of test separator 120 will generally also apply to production separator 130.

Test separator 120 comprises multiphase flow input meter 205, temperature and pressure monitor 210, gas-liquid separator 215, density & flow meter, temperature & pressure monitor 220, water analyzer device 225, liquid level control valve 230, gas flowmeter 240, gas valve 245, flow computer (or microprocessing system) 250. Test separator 120 may communicate via a communication link (e.g., wireline or wireless network) with external system 255 in order to receive commands or report test results.

Additionally, combining device 260 may recombine the separated gas and liquids in test separator 120 in order to direct the recombined multiphase fluid stream towards production separator 130. It is noted that combining device 260 is not needed in production separator 130, since the separated gas and fluids are not recombined (i.e., gas may be piped or burned in flare).

The component parts of test separator 120 (production separator 130) may be used to characterize a multiphase fluid, such as crude petroleum oil. As discussed above, many different combinations of mechanical devices and instruments can be used. The crude petroleum oil can be a liquid stream comprising oil and an aqueous or water solution, with entrained non-condensed gas. A gas-liquid-liquid multiphase fluid flow stream (i.e., oil, water gas) enters multiphase flow input 205, which may determine the flow rate of the total flow stream. Temperature and pressure monitor 210 determines the pressure of the input flow stream.

A multiphase flow stream enters gas-liquid separator 215, where a condensable and/or non-condensable gas fraction may be separated from the multiphase fluid (oil, water) to a degree consistent with the composition and physical properties of the multiphase fluid and its components, as well as the design and operating parameters of gas-liquid separator 215, as known to a person having ordinary skill in the design and operations of gas-liquid separators. Exemplary gas-liquid separators are detailed in Chapter 12 of the third printing of the Petroleum Engineering Handbook, which is hereby incorporated by reference as if fully set forth herein. FIGS. 12.23 and 12.25 from the Petroleum Engineering Handbook show schematics of typical production gas-liquid separators as can be used as separator 215.

The gas fraction flow stream exits separator 215 and enters gas flowmeter 240, which may determine the flow rate, temperature, and pressure of the gas stream. Gas valve 245 or a similar suitable device maintains the flow ratio of the gas stream.

The liquid fraction flow stream exits separator 215 and enters density & flow meter, temperature & pressure monitor 220 and water analyzer device 225. Water analyzer device 225 electrically measures water content using an electrical characterization system. A water-cut electrical characterization system that may perform the water content measurement function of water analyzer device 255 is disclosed in U.S. Pat. No. 4,996,490, which describes some of the preferred embodiments of such a water-cut electrical characterization system according to the principles of the present disclosure.

Density & flow meter, temperature & pressure monitor 220 determines density, flow rate, temperature, and pressure of the liquid stream. Liquid level control valve 230 maintains the flow ratio of the liquid steam.

In test separator 120, combining device 260 combines or mixes the gas stream from gas valve 245 and the multiphase liquid stream from liquid level control valve 230. The recombined gas and fluid is then directed to production separator 130. As noted above, combining device 260 is not needed in production separator 130, since the separated gas and fluids are not recombined.

One or more of measuring components 210, 220, 225, 230, 240, and 245 may be electrically coupled (as shown by dashed lines) to flow computer 250. In exemplary embodiments, flow computer 250 performs and outputs the calculations of, for example, the methods described in FIGS. 3 and 5. In another embodiment, flow computer 250 may transmit or output collected measurements to external system 255 where the measurements can be stored or other calculations can be performed. By way of example, the test results from test separator 120 may be transmitted to production separator 130, which would represent external system 255.

Figure 3:
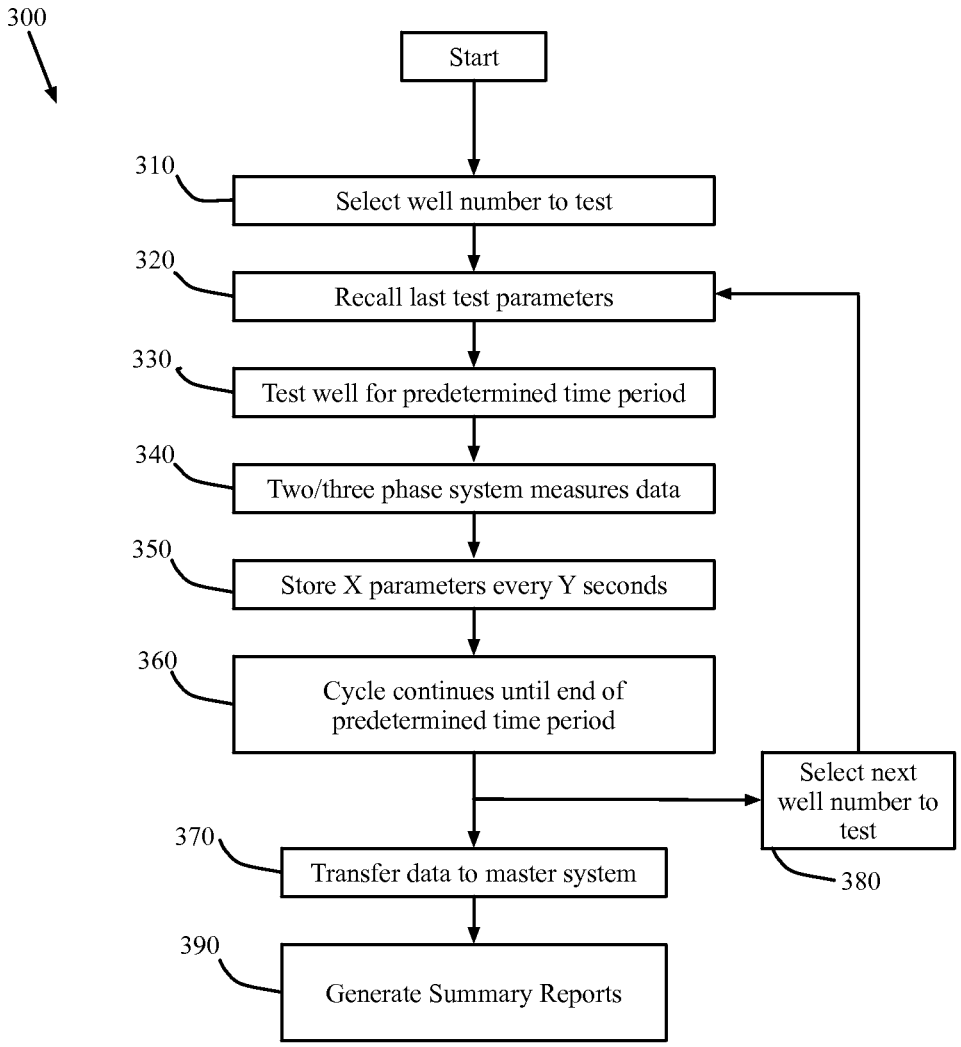
FIG. 3 is a flow diagram illustrating a test procedure performed by a test separator according to the principles of the present disclosure.

FIG. 3 depicts flow diagram 300, which illustrates a test procedure performed by test separator 120 according to the principles of the present disclosure. In an exemplary embodiment, flow computer 250 controls the overall operation of test separator 120 and is configured in software and hardware to perform the test procedures described herein.

Initially, test separator 120 selects a well (e.g., well number 4) to test (step 310) by accessing the corresponding one of test headers 110*a*-110*n* in order to draw a sample multi-phase fluid from the selected well. For the selected well, test separator 120 may then recall from data storage the test parameters measured in the last test or in one or more previous tests (step 320).

Figure 4:
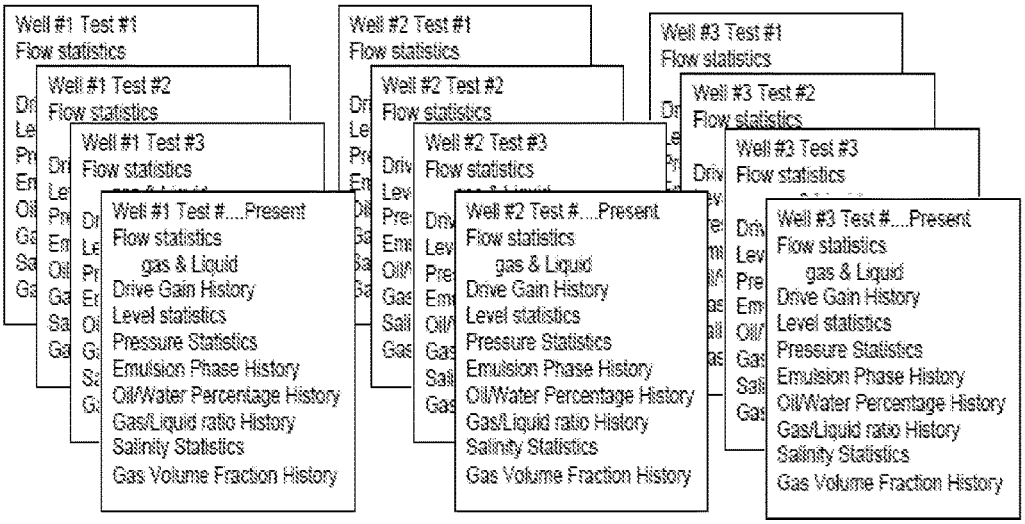
FIG. 4 illustrates exemplary test data that may be measured during a period of well tests and stored in a data storage according to an exemplary embodiment of the disclosure.

FIG. 4 illustrates exemplary test data 400 that may be measured during a period of well tests and stored in a data storage according to exemplary embodiment of the disclosure. Test data 400 for individual wells may include, but are not limited to, flow statistics for gas and liquids (i.e., water, oil), drive gain history, level statistics, pressure statistics, emulsion phase history, oil/water percentage history, gas/liquid ratio history, salinity statistics, gas volume fraction (GVF) history, and the like.

Next, test separator 120 may test the selected well for a predetermined time period (step 330). Alternatively, test separator 120 may test the selected well for a predetermined number of test samples, including a single test sample.

Depending on the architecture of test separator 120, a two-phase separator may measure data for the separated gas and liquids or a three-phase separator may measure data for the separated gas, oil, and water (step 340). During testing, test separator 120 may store X exemplary parameters every Y seconds (step 350). Test separator 120 continues cycling through tests until the end of predetermined time period expires (step 360).

Flow computer 250 may transfer the measured data to external system 255 (or a master system 255) (step 370). In some embodiments, the external system 255 may be a flow computer 250 disposed in production separator 130. Test separator 120 then selects the next well to be tested (step 380). Finally, flow computer 250 may use individual test results or aggregated test results to generate summary reports that analyze statistical deviations from real time data to better summarize and qualify a well test according to the principles of the disclosure (step 390).

In all types of well test system there are significant parameters of interest to assist in assuring good well testing has been accomplished. The present disclosure describes a statistical analysis tailored to the methods of the multiphase measurement being used. If an analysis is performed on the pertinent parameters similar to that of FIG. 5, the results after a well test would reflect what happened during the test and not just the single valued numbers that are normally accepted. This would aid in the quick analysis of wells to increase performance and discover problems.

Figure 5:
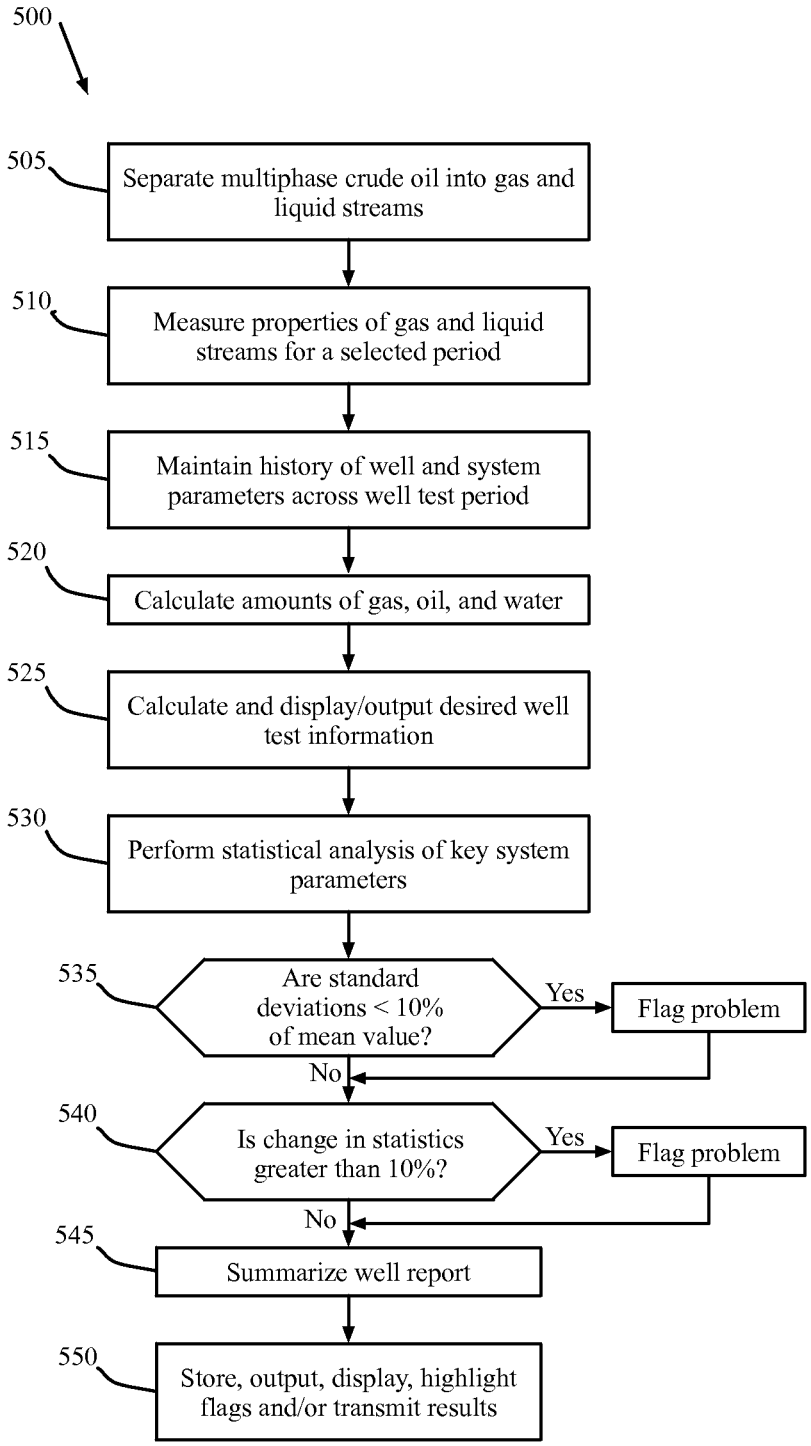
FIG. 5 is a flow diagram illustrating in greater detail a test procedure performed by a test separator or production separator according to the principles of the present disclosure.

FIG. 5 depict flow diagram 500, which illustrates in greater detail a test procedure performed by a test separator or production separator according to the principles of the present disclosure. Initially, the multiphase system separates the multiphase crude oil into a gas stream and one or more liquid (e.g., oil, water) streams (step 505). Next, the separator measure selected properties of the gas and liquid streams for a selected time period (step 510). The separator will update in memory the history of well and system parameters across the well test period (step 515).

Eventually, the multiphase system calculates, among other values, the amounts of gas, oil, and water in the multiphase stream (step 520) and calculates and displays the desired well test information, including preparing reports of key system parameters (step 525). The multiphase system then performs statistical analysis of key system parameters (step 530). As part of this analysis, the multiphase system may determine if the standard deviations are less than 10% of the mean values of selected parameters (step 535). If the standard deviation is greater than 10% ("Yes" in step 535), then the separator may flag the well as having a problem.

If the standard deviation is less than 10% ("No" in step 535), then the separator may determine if the change in one or more measured statistics or parameters is greater than 10% of a mean value of a previous measurement(s) or average(s) of the selected statistic(s) or parameter(s) (step 540). If the statistical change is greater than 10% ("Yes" in step 540), then the separator may flag the well as having a problem. If the statistical change is less than 10% ("Np" in step 540), then the separator may generate a summarized well report (step 545) and store, output, display, highlight flags, and/or transmit results (step 550) to another device.

These well tests may be used to determine each well's contribution to the output streams of the production plant. As noted above, the total measured production at the output is typically at lower pressures and temperatures than the inputs measured at the well test systems, which complicates the comparison of the sums of the individual well streams. The sum of the individual well test results when compared to the total seen at production may be expressed as a ratio and is called the "allocation factor". Typically, the allocation factor value may range from 0.9 to 1.1.

Figure 6:
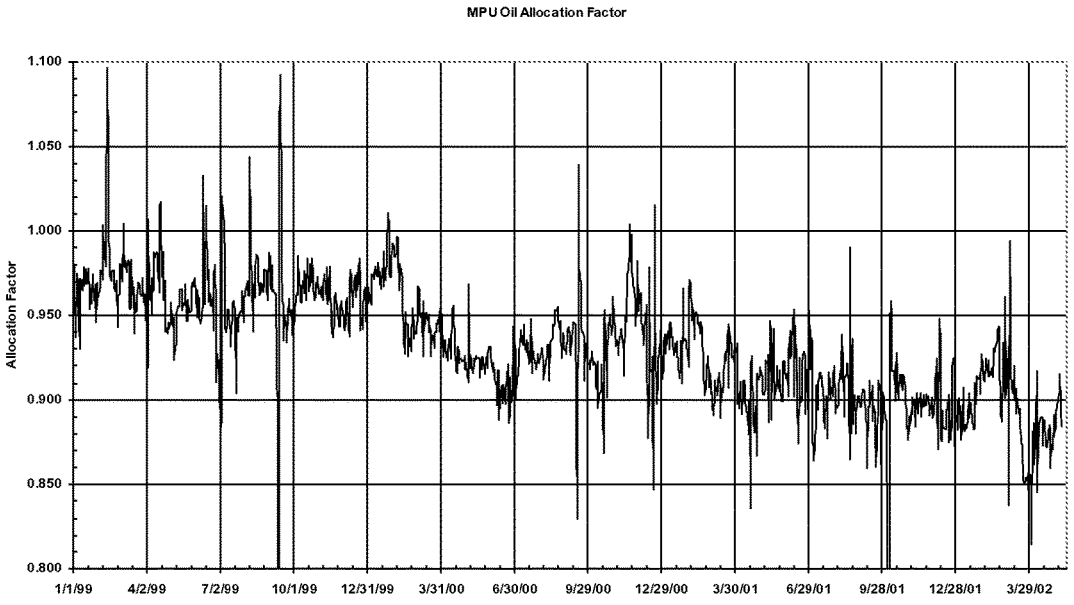
FIG. 6 is a graph of allocation factor at a processing facility that illustrates the sum of individual well tests versus the total seen at a production separator.

FIG. 6 is a graph of allocation factor at a processing facility that illustrates the sum of individual well tests versus the total seen at a production separator. It is noted that in FIG. 6, the mean value of the allocation factor decreases with time. It is desirable for a well operator to move the allocation towards the 1.00 value. The present disclosure provides information derived from well tests to enable a well operator to decide what to change to modify the allocation factor.

Conventional presentations of similar data are often difficult for the actual user of the information to interpret. FIG. 7 illustrates a standard well test subset of data. This data is very brief when real time data is viewed and analyzed over the well test period. Many corporate data centers have the real time data but the presentation to the operators and reservoir engineers is at best elementary. It does not provide insight as to the variation within a test or test parameters, such as gas and liquid density, level, or standard deviations across a test, which discloses the volatility of the data.

FIG. 8 illustrates new well test data according to an embodiment of the disclosure. The new test data parameters provide real-time updates of the mean values, the standard deviation values, the maximum values, and the minimum values of exemplary data parameters. The information in FIG. 8 is used to supplement and summarize conventional well test data, such as that in FIG. 7.

Well Measurement with Statistical Analysis

The present disclosure describes improved systems and methods for determining the amount of water, oil and gas in a crude oil flow stream. Measurements may be made in real time with data logging of the multiple parameters of the test apparatus stored and then processed to improve test results. Typical well tests range from 4 hours to 24 hours per well. As noted above, FIG. 6 illustrates exemplary test data stored in the system. This data may be taken as often as necessary, but typically is sampled and processed every 10 seconds and may contain 40 or more measured and/or calculated parameters. The selected data may be archived within the system storage for future comparisons to determine various types of anomalies.

The data in FIG. 4 may be used to perform a statistical analysis which would typically include the maximum, minimum, mean, and standard deviation(s) of the liquid and gas flow rates, pressure, temperature, separator level stability, liquid and gas density parameters. The results, shown in FIG. 8, would be in addition to the conventional well test subset of data, which is shown in FIG. 7. The two sets of data are not from the same well but are for illustration purposes only.

Data from the past several well tests are also stored to compare against the other earlier and subsequent statistical data sets. Any significant changes will be detected by the test separator or production separator and will lead to investigation of certain wells that may not be performing so that corrective actions can be established.

FIG. 9 illustrates three exemplary well test measurement data over a period of time. The first well test shows a mean value level of 59.3%, which changed in the following two well tests to mean values of 90.5% and 90.2%. It is also noted that the gas density mean value went from 11.4 $kg/m^3$ to 28.1 $kg/m^3$, and then to 28.3 $kg/m^3$, respectively for the following two tests. These levels would not have left a significant blanket of gas over the liquids, which would result in sending wet gas over the gas measurement section.

Therefore, an increase in gas density is the outcome. Conventional well test data reports would not have revealed this information to the operator.

In one embodiment of the disclosure, the test monitoring equipment in the separators assigns a qualifier from 0-10 (10 being the best) to each statistical analysis. The qualifier may be sued to identify if it is within expected reproducibility. This scale may also be related to the baseline noise in the well data to account for wells that have larger variance than others. One example of a qualifier is a value based on the standard deviation, divided by the mean value, subtracted from unity (or 1), and multiplied by 10:

$$\text{Qualifier}=[1-(\text{Std. Dev.}/\text{Mean Value})]\times 10$$

FIG. 10 illustrates three exemplary well test measurement data with additional qualifiers added in the bottom row according to an exemplary embodiment of the disclosure. In FIG. 10, the qualifier for the liquid flow rate decreased (from 6.3 to 5.1 and 5.4) because of the decreased mean value.

Two Phase Separator

A two-phase separator can be supplied in various configurations, depending upon the required measuring precision and operational envelope. The multiphase meter is based upon two-phase separation followed by conventional single-phase measurements. The bulk of the separation is achieved in the gas liquid cyclone. However, additional liquid may be removed from the gas stream in the gas scrubbing and polishing stages. This example is one of many configurations for such a separator. The differences will be in the method of gas separation with cyclones or conventional residence time in a large surface area vessel. The major difference in the cyclone version is the amount of liquids in the separator at any one time is less than one barrel and therefore the response is close to the actual well performance. The techniques applied here may be used in a conventional separator as well.

The cyclone is a static section that makes use of the centrifugal force as the driving force for separation. Liquid and gas enters a spin chamber section that sets up the rotational velocity component. The mixture then flows to the inner cyclone separation section after the spin is established. The spin section can be made up of vanes or tangential ports or, alternatively, by a single tangential entry. The swirling flow induces a centrifugal field that separates the liquid and the gas—with the liquid leaving the cyclone separation chamber in the bottom through the liquid outlet line. The main challenge in designing a gas liquid cyclone is to prevent the gas from following the liquid through the underflow of the cyclone. To prevent this, the cyclone may be equipped with a gas blockage arrangement that directs the gas toward the upper portion of the cyclone section. The gas and the remaining liquid carried by the gas leave the cyclone separation section through a vortex finder and pass through the spin section into the second stage separation chamber. This section is a scrubber and polishing stage that separates the last amount of liquid. The clean gas leaves at the top through the gas outlet line.

The separated gas may be measured using a Coriolis meter. This provides excellent turn down with no operator intervention and provides density along with the mass flow. Another advantage is that the gas parameters are not required to obtain measured volumes. Since the base measurement is one of mass and density, the amount of gas is known from the actual data. The density provides a method to determine if any liquids are being sent through the gas line. Other types of flow measurement, such as, for example, V-Cones, orifice plates, and ultrasonic, may be provided.

A differential pressure transmitter measures the height of the liquids in the separator, which is controlled by the liquid valve. A gas valve provides pressure control so that the pressure in the separator is higher than the production line pressure so it can deliver the liquids back into the production system. The separated liquid is routed through a microwave water cut analyzer and a suitable liquid flow meter (normally a Coriolis meter), so that both the oil and water flow rates can be derived. Again various devices may be used for measurement.

The multiphase meter includes a control system, a display, and a human interface that collect the data from the analyzers, transmitters and flow meters while controlling the system. On-line densitometers may also be used to ascertain the amount of water in petroleum oil. One on-line density method uses a Coriolis meter. This meter can be installed in the pipeline leaving the well or wells. Coriolis meters measure the density of a fluid or fluid mixture, and usually its mass flow rate as well, using the Coriolis effect. Then, calculations can be performed to indirectly determine the water percentage. For example, a Coriolis meter may measure the density of a water-oil mixture, $\rho_{mixture}$ and then perform a simple calculation method to determine the individual fractions or percentages of the water phase and oil phase. By knowing or assuming the density of dry oil, $\rho_{dry\ oil}$, and the density of the water phase, $\rho_{water\ phase}$, a water weight percentage, $\psi_{water}$, may be calculated as follows:

$$\psi_{water\ phase}=((\rho_{mixture}-\rho_{dry\ oil})/(\rho_{water\ phase}-\rho_{dry\ oil}))\times 100$$

It should be recognized that the water percentage by density method is subject to uncertainty. First, due to natural variations of, for example, the hydrocarbon composition of crude petroleum oil, the density of the dry oil may vary significantly from the assumed and entered value required for the simple calculation. Such a value may be entered into a densitometer based on a guess or on a history of a given hydrocarbon well, which may not be at process temperature. Crude petroleum oils may range from about 800 kilograms per cubic meter ($kg/m^3$) to about 980 $kg/m^3$. Further, the water encountered in hydrocarbon well production is often saline. This salinity is subject to variability, ranging from about 0.1% salt by weight to about 28%. This results in a variation in the density of the water phase from about 1020 $kg/m^3$ to about 1200 $kg/m^3$. Again, this value may be determined by the operator and entered into a densitometer. It is noted that an entrained gas phase may be present that will dramatically affect the density of a crude petroleum oil liquid stream as measured by a Coriolis meter, if a precise correction method is not applied for the presence of the gas.

Another technique to determine the water percentage may use a microwave analyzer, instead of a densitometer, to perform the in-line monitoring of the oil and water mixture. U.S. Pat. No. 4,862,060 to Scott entitled "Microwave Apparatus for Measuring Fluid Mixtures" (which is hereby incorporated by reference) discloses microwave apparatuses and methods that are most suitable for monitoring water percentages when the water is dispersed in a continuous oil phase.

Further uncertainty in conducting characterizations of crude petroleum oil may be caused by the physical chemistry of the oil, the water, and the mixture itself. For example, in the case of liquid-liquid mixtures undergoing mechanical energy input, the mixture usually contains a dispersed phase and a continuous phase. For water and oil, the mixture exists as either a water-in-oil or an oil-in-water dispersion. When such a dispersion changes from water phase continuous to oil phase continuous, or vice-versa, it is said to "invert the emulsion phase".

Dispersion of one phase into another occurs under mechanical energy input, such as agitation, shaking, shearing, or mixing. When the mechanical energy is reduced or eliminated, coalescing of the dispersed phase may occur, where droplets aggregate into larger and larger volumes. Further, in a substantially static situation (e.g., reduced energy input), heavy phase "settling-out" or stratification may occur under the force of gravity.

A further complicating phase-state phenomenon of liquid-liquid mixtures is that stable or semi-stable suspensions of dispersed-phase droplets may sometimes occur. This is usually referred to as an emulsion, which may be either stable or semi-stable. Certain substances are known as emulsifiers and may increase the stability of an emulsion. This means that it takes a longer time for the emulsion to separate into two phases under the force of gravity or using other means. In the case of petroleum oils, emulsifiers are naturally present in the crude petroleum oil. For example, very stable emulsions may occur during petroleum processing, as either mixtures of water-in-oil or oil-in-water.

To address the problems of phase inversion uncertainties in aqueous and non-aqueous multiphase mixtures, U.S. Pat. No. 4,996,490 to Scott, entitled "Microwave Apparatus and Method for Measuring Fluid Mixtures" (hereby incorporated by reference) discloses microwave apparatuses and methods for accommodating phase inversion events. For the example of oil and water mixtures, the '490 patent discloses techniques for determining whether a particular mixture exists as an oil-in-water or a water-in-oil dispersion using differences in the reflected microwave power curves in the two different states of the same mixture. The '490 patent disclosed microwave apparatuses and methods that include the ability to measure microwave radiation power loss and reflection to detect the state of the dispersion. The '490 patent also discloses methods to compare the measured reflections and losses to reference reflections and losses to determine the state of the mixture as either water-in-oil or oil-in-water. This allows the proper selection and comparison of reference values relating the measured microwave oscillator frequency to the percentage water.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An apparatus for analyzing the output of a plurality of oil wells comprising:

a plurality of test headers coupled to the plurality of oil wells via a field testing infrastructure;

a plurality of production headers, each of the plurality of production headers coupled to one of the plurality of wells and receiving an incoming multiphase fluid from a coupled well;

a production separator configured to receive a production multiphase fluid from the plurality of production headers;

a test separator configured to select a first well for testing and to receive a sample multiphase fluid from a first one of the plurality of test headers, the first test header associated with the first well, wherein the test separator is further configured to:

separate the sample multiphase fluid into a sample gas phase stream and a sample liquid phase stream;

measure a plurality of parameters of the sample gas phase stream and the sample liquid phase stream over a current period;

for each of the plurality of parameters, determine a mean value, a standard deviation, a maximum value, and a minimum value in the current period;

determine if a standard deviation associated with a first parameter exceeds a first threshold of a mean value associated with the first parameter;

if the standard deviation exceeds the first threshold, flag the first oil well as having a problem; and combine the sample gas phase stream and the sample liquid phase stream into an output multiphase fluid from the test separator, wherein the output multiphase from the test separator is combined with the production multiphase fluid received by the production separator.

2. The apparatus as set forth in claim 1, wherein the test separator is further configured to:

compare the mean value of the first parameter in the current period to a mean value of the first parameter in a previous period;

determine if a change in the mean value of the first parameter between the previous period and the current period exceeds a second threshold; and if the change in the mean value of the first parameter exceeds the second threshold, flag the first oil well as having a problem.

3. The apparatus as set forth in claim 1, wherein the test separator is further configured to:

compare the maximum value of the first parameter in the current period to a maximum value of the first parameter in a previous period;

determine if a change in the maximum value of the first parameter between the previous period and the current period exceeds a second threshold; and if the change in the maximum value of the first parameter exceeds the second threshold, flag the first oil well as having a problem.

4. The apparatus as set forth in claim 1, wherein the test separator is further configured to:

compare the minimum value of the first parameter in the current period to a minimum value of the first parameter in a previous period;

determine if a change in the minimum value of the first parameter between the previous period and the current period exceeds a second threshold; and if the change in the maximum value of the first parameter exceeds the second threshold, flag the first oil well as having a problem.

5. The apparatus as set forth in claim 1, wherein the test separator is further configured to:

determine a qualifier for a well test, the qualifier identifying a degree to which the well test is within expected reproducibility.

6. The apparatus as set forth in claim 5, wherein the qualifier is given by:

$$\text{Qualifier}=[1-(\text{Std. Dev.}/\text{Mean Value})]\times 10.$$

7. The apparatus as set forth in claim 5, wherein the qualifier is given by a statistical correlation.

8. The apparatus as set forth in claim 5, wherein the qualifier is given by a variance calculation.

9. A method of analyzing the output of a plurality of oil wells, each of the oil wells coupled to one of a plurality of test headers, the method comprising:

in a first one of the plurality of test headers, obtaining a sample multiphase fluid from a first one of the plurality of oil wells;

selecting the first well for testing and receiving in a test separator the sample multiphase fluid from the first test header, the first test header associated with the first well;

in the test separator, separating the sample multiphase fluid into a sample gas phase stream and a sample liquid phase stream;

measuring a plurality of parameters of the sample gas phase stream and the sample liquid phase stream over a current period;

for each of the plurality of parameters, determining a mean value, a standard deviation, a maximum value, and a minimum value in the current period;

determining if a standard deviation associated with a first parameter exceeds a first threshold of a mean value associated with the first parameter;

if the standard deviation exceeds the first threshold, flagging the first oil well as having a problem; and combining the sample gas phase stream and the sample liquid phase stream into an output multiphase fluid from the test separator; and combining the output multiphase fluid from the test separator with a production multiphase fluid that is flowing to a production separator.

10. The method as set forth in claim 9, further comprising:

comparing the mean value of the first parameter in the current period to a mean value of the first parameter in a previous period; and determining if a change in the mean value of the first parameter between the previous period and the current period exceeds a second threshold; and if the change in the mean value of the first parameter exceeds the second threshold, flagging the first oil well as having a problem.

11. The method as set forth in claim 9, further comprising:

comparing the maximum value of the first parameter in the current period to a maximum value of the first parameter in a previous period; and determining if a change in the maximum value of the first parameter between the previous period and the current period exceeds a second threshold; and if the change in the maximum value of the first parameter exceeds the second threshold, flagging the first oil well as having a problem.

12. The method as set forth in claim 9, further comprising:

comparing the minimum value of the first parameter in the current period to a minimum value of the first parameter in a previous period; and determining if a change in the minimum value of the first parameter between the previous period and the current period exceeds a second threshold; and if the change in the maximum value of the first parameter exceeds the second threshold, flagging the first oil well as having a problem.

13. The method as set forth in claim 9, further comprising:

determining a qualifier for a well test, the qualifier identifying a degree to which the well test is within expected reproducibility.

14. The method as set forth in claim 13, wherein the qualifier is given by:

$$\text{Qualifier}=[1-(\text{Std. Dev.}/\text{Mean Value})]\times 10.$$

15. The method as set forth in claim 13, wherein the qualifier is given by a statistical correlation.

16. The method as set forth in claim 13, wherein the qualifier is given by a variance calculation.

* * * * *